US006644260B2

(12) United States Patent
Tsukii et al.

(10) Patent No.: US 6,644,260 B2
(45) Date of Patent: Nov. 11, 2003

(54) INTAKE MANIFOLD

(75) Inventors: Tsutomu Tsukii, Wako (JP); Masashi Maruyama, Wako (JP); Yoshihiro Akiyama, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/168,539

(22) PCT Filed: Sep. 4, 2001

(86) PCT No.: PCT/JP01/07655

§ 371 (c)(1),
(2), (4) Date: Jul. 1, 2002

(87) PCT Pub. No.: WO02/23034

PCT Pub. Date: Mar. 21, 2002

(65) Prior Publication Data

US 2003/0010309 A1 Jan. 16, 2003

(30) Foreign Application Priority Data

Sep. 12, 2000 (JP) ..... 2000-277031

(51) Int. Cl.[7] ..... F02M 35/10
(52) U.S. Cl. ..... 123/184.42
(58) Field of Search ..... 123/184.38, 184.39, 123/184.42, 184.61

(56) References Cited

U.S. PATENT DOCUMENTS 4,932,369 A * 6/1990 Parr ..... 123/184.42

FOREIGN PATENT DOCUMENTS

| | | |
|---|---|---|
| EP | 0 984 156 A2 | 3/2000 |
| JP | 57-63919 | 4/1982 |
| JP | 1-69128 | 5/1989 |
| JP | 10-299591 | 11/1998 |
| JP | 10-339224 | 12/1998 |
| JP | 2000-179416 | 6/2000 |

* cited by examiner

*Primary Examiner*—Noah P. Kamen
(74) *Attorney, Agent, or Firm*—Arent Fox Kintner Plotkin & Kahn PLLC

(57) ABSTRACT

An intake manifold made of a synthetic resin includes a surge tank, and a plurality of intake pipes disposed in parallel to one another and each having a rising pipe portion which is connected to a lower portion of the surge tank and extends upwards. A space is defined between the surge tank and each of the rising pipe portions, as viewed sideways. In order to enable an increase in volume of the surge tank, while avoiding an increase in size of the intake manifold, the surge tank (20) includes a main tank portion (20*a*) extending in a direction (28) of arrangement of the intake pipes (21A to 21D) and opposed to the rising pipe portions (29A to 29D) of the intake pipes (21A to 21D), and a sideways-bulged portion (20*b*) which is bulged from an intermediate portion of the main tank portion (20*a*) as viewed in the arrangement direction (28) and is interposed between a pair of rising pipe portions (29B, 29C) disposed at the intermediate portion as viewed in the arrangement direction 28. Inner ends of a pair of the spaces (38) defined respectively between the rising pipe portions (29A to 29D) and the main tank portion (20*a*) on opposite sides of the sideways-bulged portion (20*b*) are closed by opposite sidewalls of the sideways-bulged portion (20*b*).

14 Claims, 9 Drawing Sheets

INTAKE MANIFOLD

FIELD OF THE INVENTION

The present invention relates to an intake manifold formed by bonding a plurality of parts made of synthetic resin to one another, and including a surge tank disposed sideways of an engine body, and a plurality of intake pipes disposed in parallel to one another and each having a rising pipe portion which is connected to a lower portion of the surge tank on a side opposite from the engine body, and extends upwards, a space being defined between the surge tank and each of the rising pipe portions, as viewed sideways in a direction parallel to a direction of arrangement of the intake pipes.

BACKGROUND ART

Such an intake manifold is already known, for example, from Japanese Patent Application Laid-open No.10-299591 and the like. In such intake manifold, the surge tank is formed to have a rectangular cross section longer in a direction of arrangement of a plurality of intake pipes, and a space is defined between the surge tank and a rising pipe of each of the intake pipes connected to a lower portion of the surge tank to extend in the direction of arrangement of the intake pipes with its opposite ends opened.

In the intake manifold having the above-described structure, the space between the surge tank and the rising pipe portion of each intake pipe is not utilized effectively, and to increase the volume of the surge tank, while avoiding an increase in size of the intake manifold, it is necessary to effectively utilize the space.

DISCLOSURE OF THE INVENTION

The present invention has been accomplished in view of the above circumstances, and it is an object of the present invention to provide an intake manifold designed so that the volume of a surge tank can be increased, while avoiding an increase in size of the intake manifold.

To achieve the above object, according to a first aspect and feature of the present invention, there is provided an intake manifold formed by bonding a plurality of bonded parts made of synthetic resin to one another, and including a surge tank disposed sideways of an engine body, and a plurality of intake pipes disposed in parallel to one another and each having a rising pipe portion which is connected to a lower portion of the surge tank on a side opposite from the engine body, and extends upwards, a space being defined between the surge tank and each of the rising pipe portions, as viewed sideways in a direction parallel to a direction of arrangement of the intake pipes, characterized in that the surge tank includes a main tank portion extending in the direction of arrangement of the intake pipes and opposed to the rising pipe portions of the intake pipes, and a sideways-bulged portion which is bulged to a side opposite from the engine body from an intermediate portion of the main tank portion as viewed in the arrangement direction to form a cross-sectional T-shape by cooperation with the main tank portion, the sideways-bulged portion being interposed between the rising pipe portions of a pair of the intake pipes disposed at the intermediate portion as viewed in the arrangement direction, and inner ends of a pair of spaces defined respectively between the rising pipe portions of the intake pipes and the main tank portion on opposite sides of the sideways-bulged portion are closed by opposite sidewalls of the sideways-bulged portion.

With such arrangement of the first feature, the cross-sectional shape of the surge tank is a T-shape in such a manner the space defined between the surge tank and the rising pipe portion of each of the intake pipes as viewed sideways in the direction parallel to the direction of arrangement of the intake pipes is bisected. Thus, notwithstanding that the spaces similar to those in the prior art as viewed sideways exist between the surge tank and the rising pipe portions, a portion sandwiched between the spaces can be utilized effectively as a portion of the surge tank, whereby the volume of the surge tank can be increased, while avoiding an increase in size of the entire intake manifold. Moreover, the opposite sidewalls of the sideways-bulged portion forming a portion of the surge tank are disposed at locations displaced inwards from opposite ends of the intake manifold in the direction of arrangement of the intake pipes and hence, a radiated sound from each of the opposite sidewalls of the sideways-bulged portion can be prevented as much as possible from being leaked to the outside.

According to a second aspect and feature of the present invention, in addition to the first feature, the sideways-bulged portion, the rising pipe portions of the intake pipes and the main tank portion are connected together by connecting walls disposed in the spaces respectively. With such arrangement, the rigidity of the surge tank and the intake pipes can be increased, and the radiated sound from the intake manifold can be reduced. Moreover, since the connecting walls are disposed in the spaces, the size of the intake manifold cannot be increased due to the provision of the connecting walls.

According to a third aspect and feature of the present invention, in addition to the second feature, a plurality of the intake pipes are disposed on each of the opposite sides of the sideways-bulged portion, the rising pipe portions of such plurality of intake pipes being connected to each other by the connecting walls. With such arrangement, the rigidity of the plurality of intake pipes is increased and hence, the radiated sound from each of the intake pipes can be reduced.

According to a fourth aspect and feature of the present invention, in addition to the second or third feature, the connecting walls are disposed on a plane intersecting a junction between the parts bonded to each other. With such arrangement, the bond rigidity of the junction at portions corresponding to the connecting walls can be increased.

According to a fifth aspect and feature of the present invention, in addition to any of the second, third and fourth features, a pair of connecting walls are disposed in the space at locations such that the volume of a space portion between a ceiling wall of the space and one of the connecting walls, the volume of a space portion between both of the connecting walls and the volume of a space portion between a bottom wall of the space and the other connecting wall are different from one another. With such arrangement, it is possible to provide an excellent effect of attenuating the radiated sound from the intake manifold.

According to a sixth aspect and feature of the present invention, in addition to the first feature, a lattice-shaped rib is projectingly provided on an outer surface of an end wall of the sideways-bulged portion to connect the rising pipe portions on opposite sides of the sideways-bulged portion to each other, the rib being connected to junctions between the plurality of bonded parts forming at least a portion of the surge tank. With such arrangement, the connection rigidity of the surge tank and both of the intake pipes can be increased remarkably by the lattice-shaped rib. Thus, it is possible to increase the entire rigidity of the intake manifold to reduce the radiated sound. In addition, the rigidity of at least a portion of each of the junctions included in the intake manifold can be further increased by the connection of the rib to the junctions between the plurality of bonded parts forming at least a portion of the surge tank.

According to a seventh aspect and feature of the present invention, in addition to the first feature, the surge tank further includes a pair of downward-bulged portions bulged downwards from opposite ends of the main tank portion and connected to lower ends of the rising pipe portions, and a lattice-shaped rib is projectingly provided on an outer surface of a bottom wall of the central portion of the surge tank sandwiched between the downward-bulged portions to connect the downward-bulged portions to each other, the lattice-shaped rib being connected to a junction between the plurality of bonded parts forming at least a portion of the surge tank. With such arrangement, the lattice-shaped rib is projectingly provided on the outer surface of the bottom wall of the central portion of the surge tank by effectively utilizing an unoccupied space created between the pair of downward-bulged portions. Thus, it is possible to increase the rigidity of the surge tank remarkably, while avoiding an increase in size of the intake manifold, thereby increasing the entire rigidity of the intake manifold to reduce the radiate sound. In addition, the rigidity of at least a portion of each of the junctions included in the intake manifold can be further increased by the connection of the rib to the junctions between the plurality of bonded parts forming at least a portion of the surge tank.

According to an eighth aspect and feature of the present invention, in addition to the first feature, a lattice-shaped rib is projectingly provided on an outer surface of the main tank portion on the side of the engine body and connected to junctions between the plurality of bonded parts forming at least a portion of the surge tank. With such arrangement, the lattice-shaped rib is provided on the outer surface of the main tank portion on the side of the engine body forming a portion of the surge tank by effectively utilizing a space between the engine body and the surge tank. Therefore, the rigidity of the surge tank can be increased remarkably, while avoiding an increase in size of the intake manifold, thereby increasing the entire rigidity of the intake manifold to reduce the radiated sound. In addition, the rigidity of at least a portion of each of the junctions included in the intake manifold can be further increased by the connection of the rib to the junctions between the plurality of bonded parts forming at least a portion of the surge tank.

According to a ninth aspect and feature of the present invention, in addition to the first feature, a flange is commonly connected to the plurality of intake pipes and fastened to the engine body, and includes a base plate formed into a flat shape and connected commonly to the intake pipes, a plurality of connecting tubular portions which have endless seal-mounting grooves in end faces thereof on the side of the engine body, and individually lead to the intake pipes to be connected to the base plate, a plurality of boss portions which are formed into a tubular shape with bolt-insertion bores provided therein for fastening the flange to the engine body, and are connected to the base plate so as to be respectively disposed at least at upper and lower locations between the connecting tubular portions, and a plurality of radiate ribs which extend radiately from the boss portions and are connected to the base plate so as to be connected to the connecting tubular portions adjacent the boss portions, wherein a plurality of seal members are mounted in the seal-mounting grooves, respectively and interposed between the flange and the engine body.

With the such arrangement of the ninth feature, the fastening rigidity of the entire flange to the engine body can be increased by the radiate ribs extending radiately from the boss portions and connecting the boos portions and the connecting tubular portions, while avoiding an increase in thickness of the entire flange to prevent an increase in weight of the flange. Moreover, a fastening force is applied to a plurality of circumferential points of each of the connecting tubular portions from the boss portions through the radiate ribs, leading to an enhancement in sealing performance provided by the seal members mounted in the seal-mounting grooves provided in the end faces of the connecting tubular grooves on the side of the engine body.

According to a tenth aspect and feature of the present invention, in addition to the first feature, a flange is commonly connected to the plurality of intake pipes and fastened to the engine body, and includes a base plate formed into a flat shape and connected commonly to the intake pipes, a plurality of connecting tubular portions, which have endless seal-mounting grooves and grooves in end faces thereof on the side of the engine body, the latter grooves being connected at inner ends thereof to the seal-mounted grooves and opening at outer ends thereof into a side of the flange, the connecting tubular portions individually leading to the intake pipes and being connected to the base plate, a plurality of boss portions which are formed into a tubular shape with bolt-insertion bores provided therein for fastening the flange to the engine body, and are connected to an outer periphery of the base plate so as to be respectively disposed at least at upper and lower locations between the connecting tubular portions, and an outer peripheral rib which connects the connecting tubular portions and the boss portions to each other, and are connected to opposite sides of the grooves in the connecting tubular portions and to the outer periphery of the base plate, wherein a plurality of seal members integrally provided with protrusion to be fitted into the latter grooves are mounted in the seal-mounting grooves, respectively and interposed between the flange and the engine body.

With the arrangement of the tenth feature, the fastening rigidity of the flange to the engine body can be increased by the outer peripheral rib disposed around the outer periphery of the flange to connect the boss portions and the connecting tubular portions to each other, while avoiding an increase in thickness of the entire flange to prevent an increase in weight of the flange. Moreover, the seal members mounted in the seal-mounting grooves provided in the end faces of the connecting tubular portions on the side of the engine body are integrally provided with the protrusions which are to be fitted into the grooves provided in the end faces of the connecting tubular portions with their inner ends connected to the seal-mounting grooves and with their outer ends opening into the side of the flange. Therefore, in a state in which the flange has been fastened to the engine body, the presence or absence of the protrusions, i.e., the presence or absence of the seal member can be visually checked from outside the flange. In addition, since the outer peripheral rib is connected to the connecting tubular portions on the opposite sides of the grooves, it is possible to prevent a reduction in rigidity of the connecting tubular portions due to the provision of the grooves, to inhibit a reduction in sealing performance provided by the seal members, and to reduce the length of each of the grooves and the size of the protrusions of the seal members, while avoiding an increase in size of the flange.

According to an eleventh aspect and feature of the present invention, in addition to the arrangement of the first feature, the bonded part forming a portion of the surge tank is formed with a bent portion bent toward the inside of the surge tank, the bent portion being provided at an outer surface thereof with a rib connected to a junction between the bonded part having the bent portion and the other bonded part. With such arrangement, the rigidity of a portion of the bonded part at a location facing the surge tank can be increased by the bent portion bent toward the inside of the surge tank and by the rib formed on the outer surface of the bent portion. In addition, since the rib is connected to the junction, the pressure-resistant strength of the junction to a variation in pressure can be increased with a simple structure and thus, the durability of the junction can be enhanced. Moreover, since the bent portion is disposed to face the inside of the surge tank, an influence exerted on a flow of intake air flowing within the intake manifold by the bent portion is small.

According to a twelfth aspect and feature of the present invention, in addition to the eleventh feature, the bonded part having the bent portion is formed with a bonding collar protruding from the bent portion to become bonded to the other bonded part. With such arrangement, the bent portion is formed on one of a pair of the bonded parts in proximity to the junction between such pair of bonded parts and hence, it is possible to further enhance the durability of the junction bonding both of the bonded parts.

According to a thirteenth aspect and feature of the present invention, in addition to the first feature, at least one of the bonded parts is formed with a pressure-variation absorbing portion for absorbing a variation in pressure within each of the surge tank and the intake pipes by the flexing thereof. With such arrangement, when the pressure within the intake manifold is varied, the pressure-variation absorbing portion is flexed to absorb such variation in pressure. Therefore, it is possible to reduce a load applied to the junctions between the bonded parts, leading to an increase in pressure-resistant strength of the junctions to contribute to an enhancement in durability of the junctions.

According to a fourteenth aspect and feature of the present invention, in addition to the thirteenth feature, the pressure-variation absorbing portion of a shape bent toward the inside of the surge tank is formed on the bonded part forming a portion of the surge tank. With such arrangement, the durability of the junction can be enhanced with a simple structure. Further, the pressure-variation absorbing portion is disposed to face the inside of the surge tank and hence, an influence exerted on a flow of intake air flowing within the intake manifold by the pressure-variation absorbing portion is small.

The above and other objects, features and advantages of the invention will become apparent from the following description of the preferred embodiments taken in conjunction with the accompanying drawings.

BRIEF DESCRIPTION OF THE DRAWINGS

FIGS. 1 to 8 show a first embodiment of the present invention, wherein FIG. 1 is a side view of an engine body and an intake device;

FIG. 2 is a perspective view of a throttle body and an intake manifold;

FIG. 3 is a plan view taken in the direction of an arrow 3 in FIG. 2;

FIG. 4 is a view of the intake manifold taken in the direction of an arrow 4 in FIG. 1;

FIG. 5 is a view taken in the direction of an arrow 5 in FIG. 4;

FIG. 6 is a sectional view taken along a line 6—6 in FIG. 5;

FIG. 7 is a sectional view taken along a line 7—7 in FIG. 4;

FIG. 8 is a sectional view taken along a line 8—8 in FIG. 4.

BEST MODE FOR CARRYING OUT THE INVENTION

Figure 1:
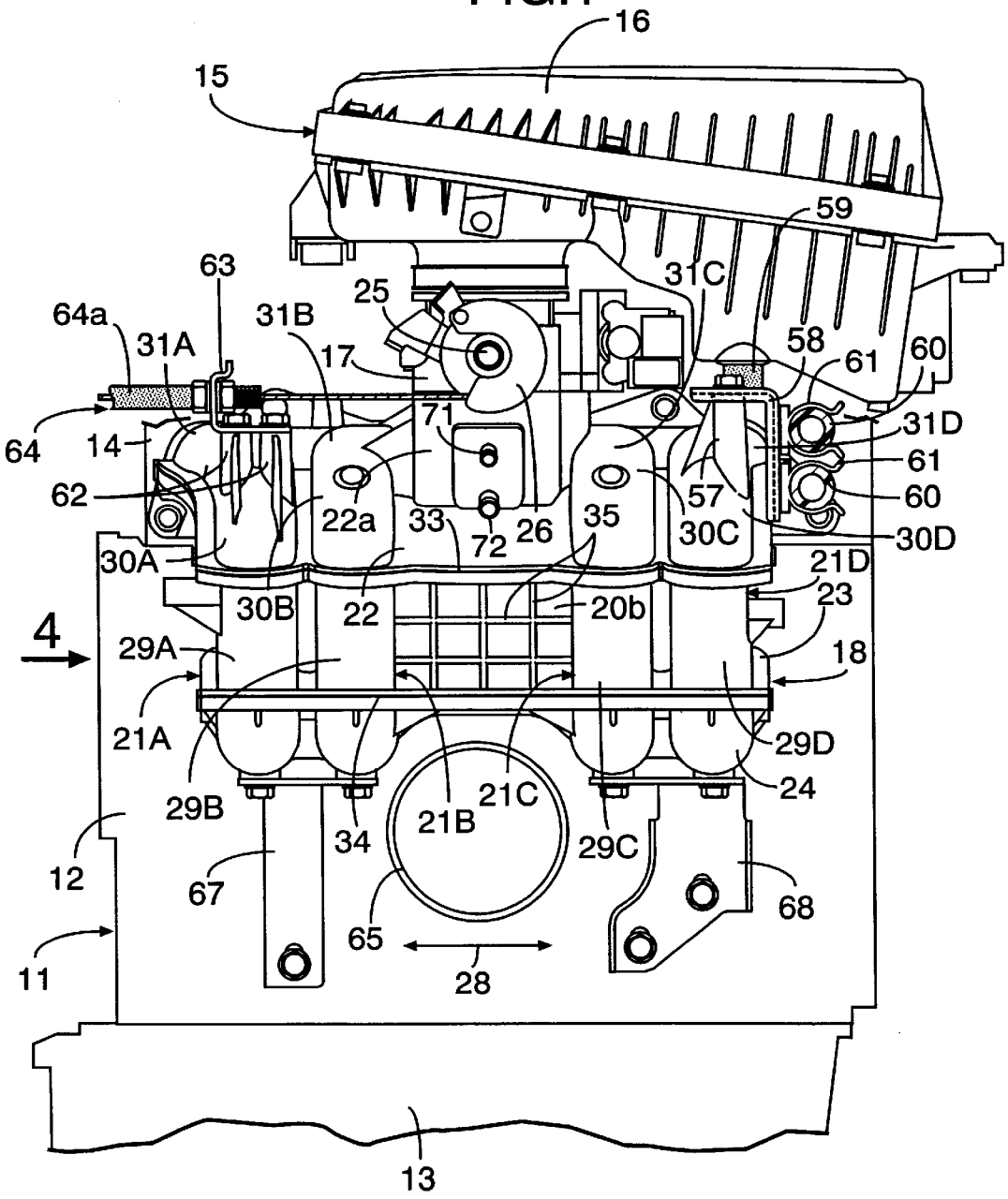

A first embodiment of the present invention will now be described with reference to FIGS. 1 to 8. Referring first to FIG. 1, an engine body 11 of a multi-cylinder engine, e.g., a 4-cylinder engine mounted on a vehicle includes a cylinder block 12, a crankcase 13 and a cylinder head 14. An intake device 15 is disposed sideways of the engine body 11. The intake device 15 is constructed compactly and includes an air cleaner 16, a throttle body 17 connected to a lower portion of the air cleaner 16, and an intake manifold 18 connected to the throttle body 17. The intake manifold 18 is connected to intake ports (not shown) provided in the cylinder head 14 in correspondence to the cylinders, respectively.

Figure 2:
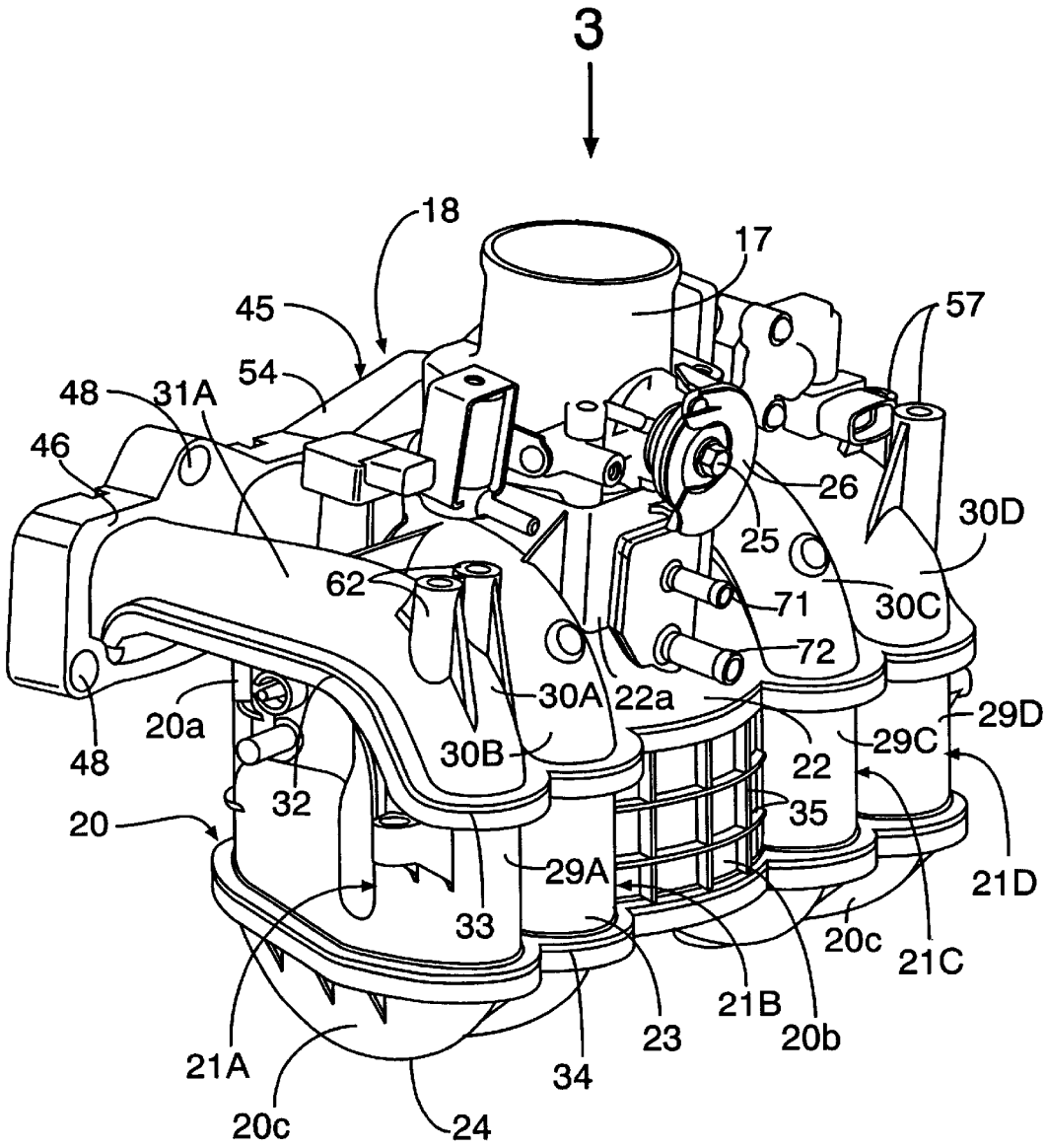
Figure 3:
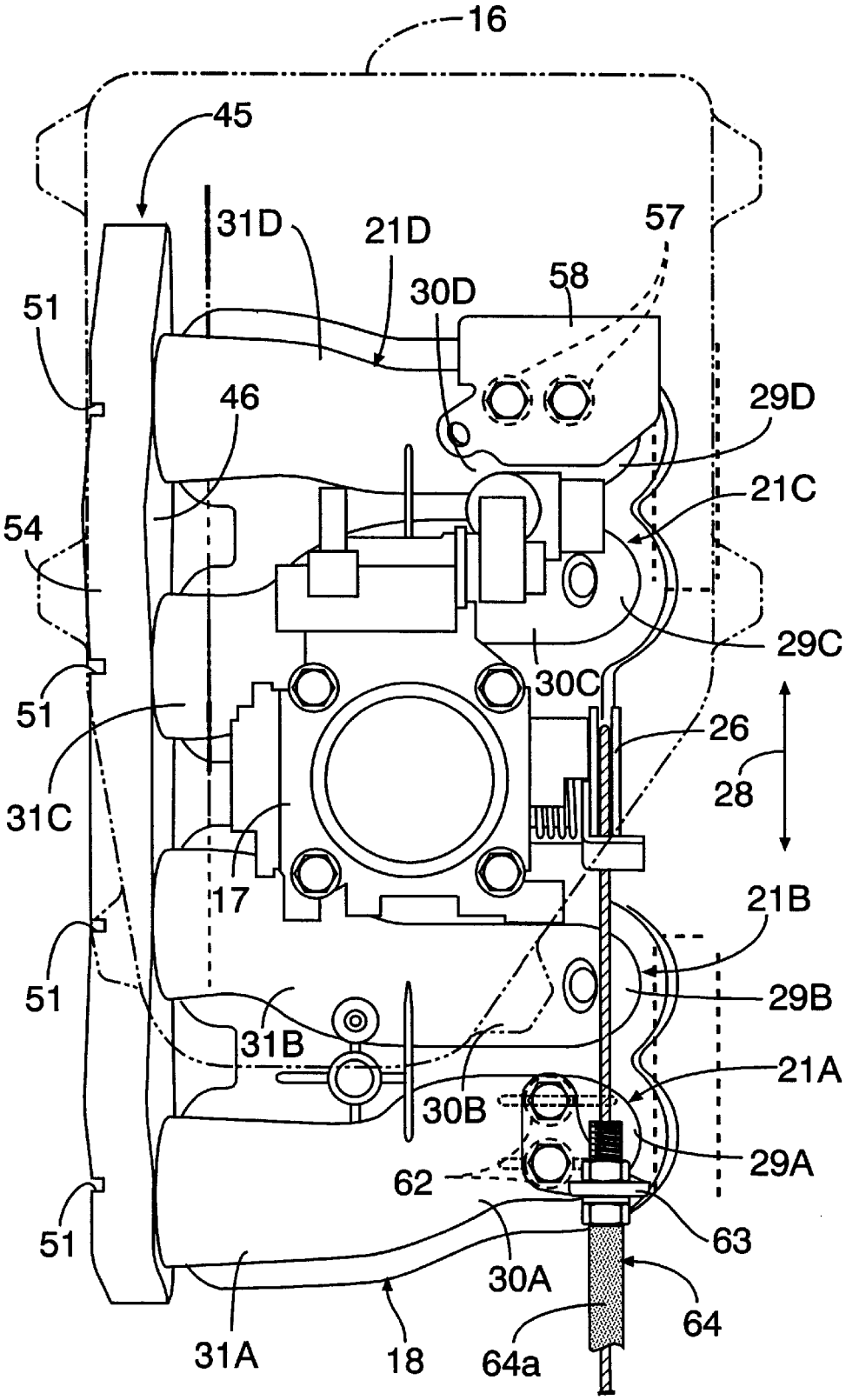

Referring to FIGS. 2 and 3, the intake manifold 18 is integrally provided with a surge tank 20 disposed sideways of the engine body 11, and a plurality of, e.g., four intake pipes 21A, 21B, 21C and 21D which are disposed in parallel in a direction parallel to a direction of arrangement of the cylinders in the engine body 11 to interconnect the intake ports in the cylinder head 14 and the surge tank 20. The intake manifold 18 is formed by bonding a plurality of, e.g., first, second and third three parts to be bonded 22, 23 and 24 each made of a synthetic resin to one another by a vibration welding, for example.

The throttle body 17 is formed into a vertically extending cylindrical shape and coupled to the central portion of an upper surface of the first bonded part 22. A butterfly throttle valve (not shown) for controlling the amount of flowing of air is secured to a valve shaft 25 rotatably carried on the throttle body 17, and a throttle drum 26 is attached to an end of the valve shaft 25 protruding from the throttle body 17.

Referring also to FIGS. 4 to 7, the first bonded part 22 is integrally provided at its central portion with a connecting tube portion 22*a* for coupling the throttle body 17, and the surge tank 20 has an intake chamber 27 defined therein and connected to the connecting tube portion 22*a*, and is formed by bonding the first, second and third bonded parts 22, 23 and 24 to one another.

The surge tank 20 is integrally provided with the following portions: a main tank portion 20*a* disposed to extend through a long distance sideways of the engine body 11 in the direction of arrangement of the cylinder, i.e., in a direction 28 of arrangement of the intake pipes 21A to 21D, a sideways-bulged portion 20*b* bulged to a side opposite from the engine body 11 from an intermediate portion (the central portion in the present embodiment) of the main tank portion 20*a* as viewed in the arrangement direction 28, and a pair of downward-bulged portions 20*c*, 20*c* bulged downwards from opposite ends of the main tank portion 20*a*. The main tank portion 20*a* and the sideways-bulged portion 20*b* are connected to each other, so that a portion extending in the direction of arrangement of the cylinders sideways of the engine body 11 and a portion extending in a direction away from the engine body 11 intersect each other to form a T-shape in cross section.

The intake pipe 21A comprises a rising pipe portion 29A which is connected at its lower portion to the downward-bulged portions 20*c* included in the surge tank 20, and extends upwards on a side of the main tank portion 20*a* opposite from the engine body 11, a curved pipe portion 30A curved in a range of substantially 90 degree within a vertical plane and connected at one end thereof to an upper end of the rising pipe portion 29A, and a straight pipe portion 31A connected at one end thereof to the other end of the curved pipe portion 30A and extending substantially horizontally. The intake pipe 21A is of a shape curved at substantially 90 degree in a projection view on the vertical plane.

Each of the other intake pipes 21B, 21C and 21D is also formed in the same manner as the intake pipe 21A and thus, includes a rising pipe portion 29B, 29C, 29D, a curved pipe portion 30B, 30C, 30D and a straight pipe portion 31B, 31C, 31D. Each of the intake pipes 21B, 21C and 21D is also of a shape curved at substantially 90 degree in a projection view on the vertical plane.

Figure 4:
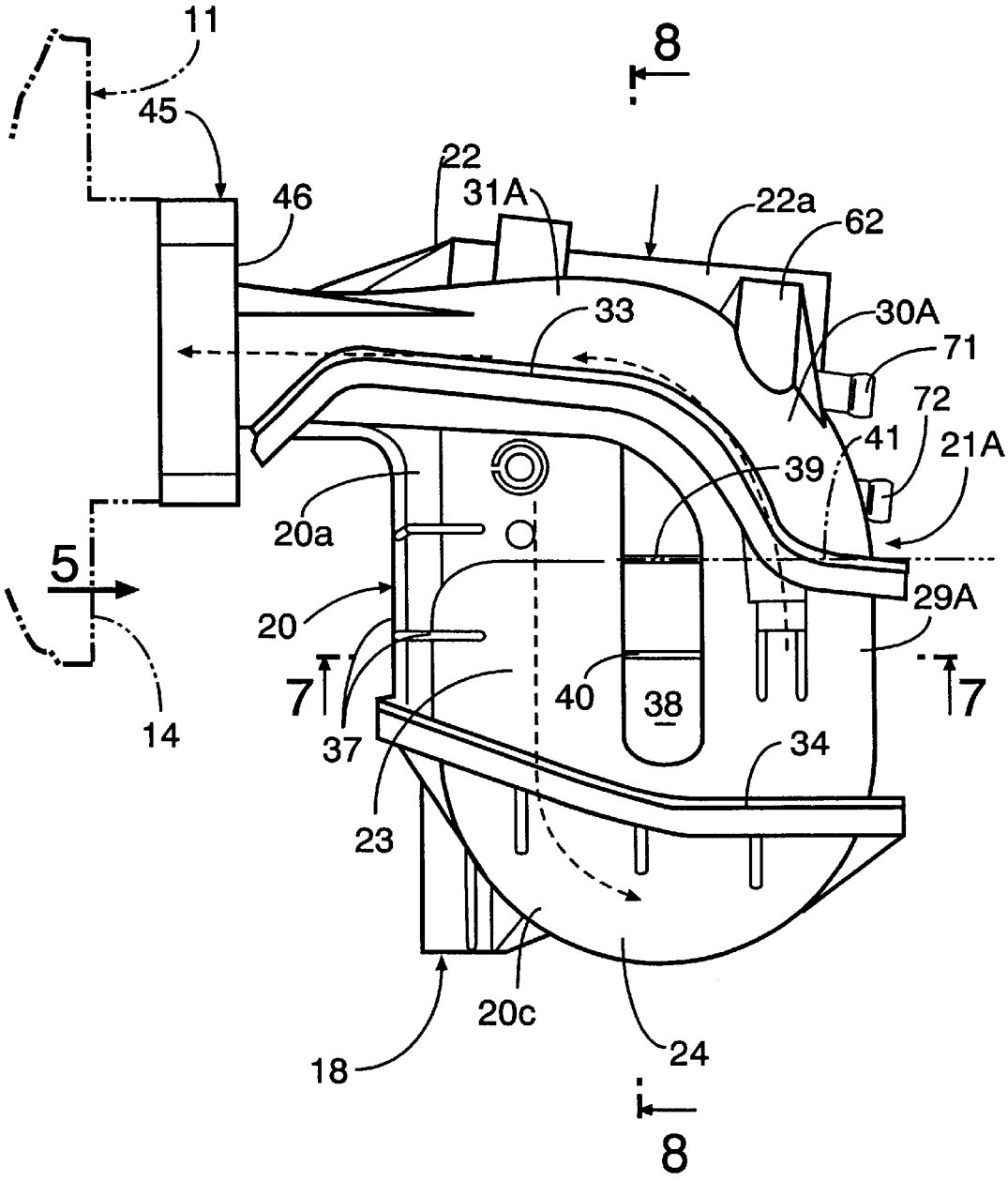
Figure 5:
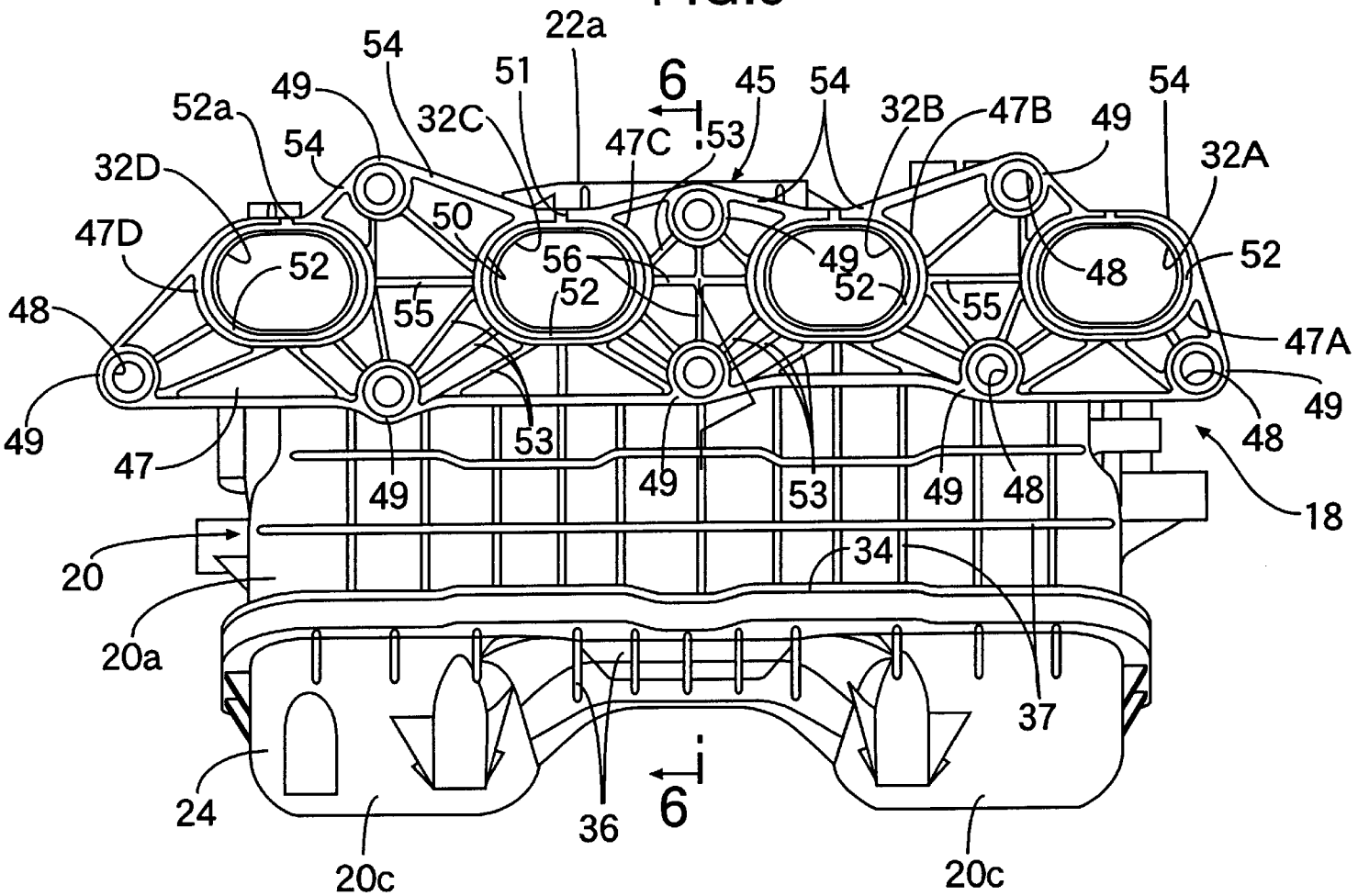

Intake passages 32A, 32B, 32C and 32D are defined within the intake pipes 21A, 21B, 21C and 21D, respectively, so that air introduced from the throttle body 17 into the intake manifold 18 flows downwards within the surge tank 20, as shown by a dashed line arrow in FIG. 4 and is then turned upwards and diverted into the intake passages 32A to 32D. The air introduced into the intake passages 32A to 32D flows upwards, and is then turned through substantially 90 degree to flow substantially horizontally toward the cylinder head 14 of the engine body 11.

The sideways-bulged portion 20*b* of the surge tank 20 is interposed between the rising pipe portions 29B and 29C included in the pair of intake pipes 21B and 21C disposed at intermediate locations (central locations in the present embodiment) in the direction 28 of arrangement of the intake pipes 21A to 21D. A lattice-shaped rib 35 is projectingly provided on an outer surface of an end wall of the sideways-bulged portion 20*b* opposite from the main tank portion 20*a* to connect the rising pipe portions 29B and 29C to each other, and is connected to a junction 33 between the first and second bonded parts 22 and 23 as well as to a junction 34 between the second and third bonded parts 23 and 24.

At a location sandwiched between the downward-bulged portions 20*c*, 20*c* provided on opposite sides of the surge tank 20, a bottom wall of the central portion of the surge tank 20, i.e., each of the central portion of the main tank portion 20*a* and the sideways-bulged portion 20*b* is formed into such a shape that it protrudes more upwards than the downward-bulged portions 20*c*, 20*c*. A lattice-shaped rib 36 is projectingly provided on such bottom wall of the central portion of the surge tank 20 to connect both of the downward-bulged portions 20*c*, 20*c* to each other, and is connected to the junction between the second and third bonded parts 23 and 24.

Further, a lattice-shaped rib 37 is projectingly provided on an outer surface of the main tank portion 20*a* on the side of the engine body 11, for example, on the entire surface, and the junction 33 between the first and second bonded parts 22 and 23 and the junction 34 between the second and third bonded parts 23 and 24 are connected to each other by the lattice-shaped rib 37.

Figure 8:
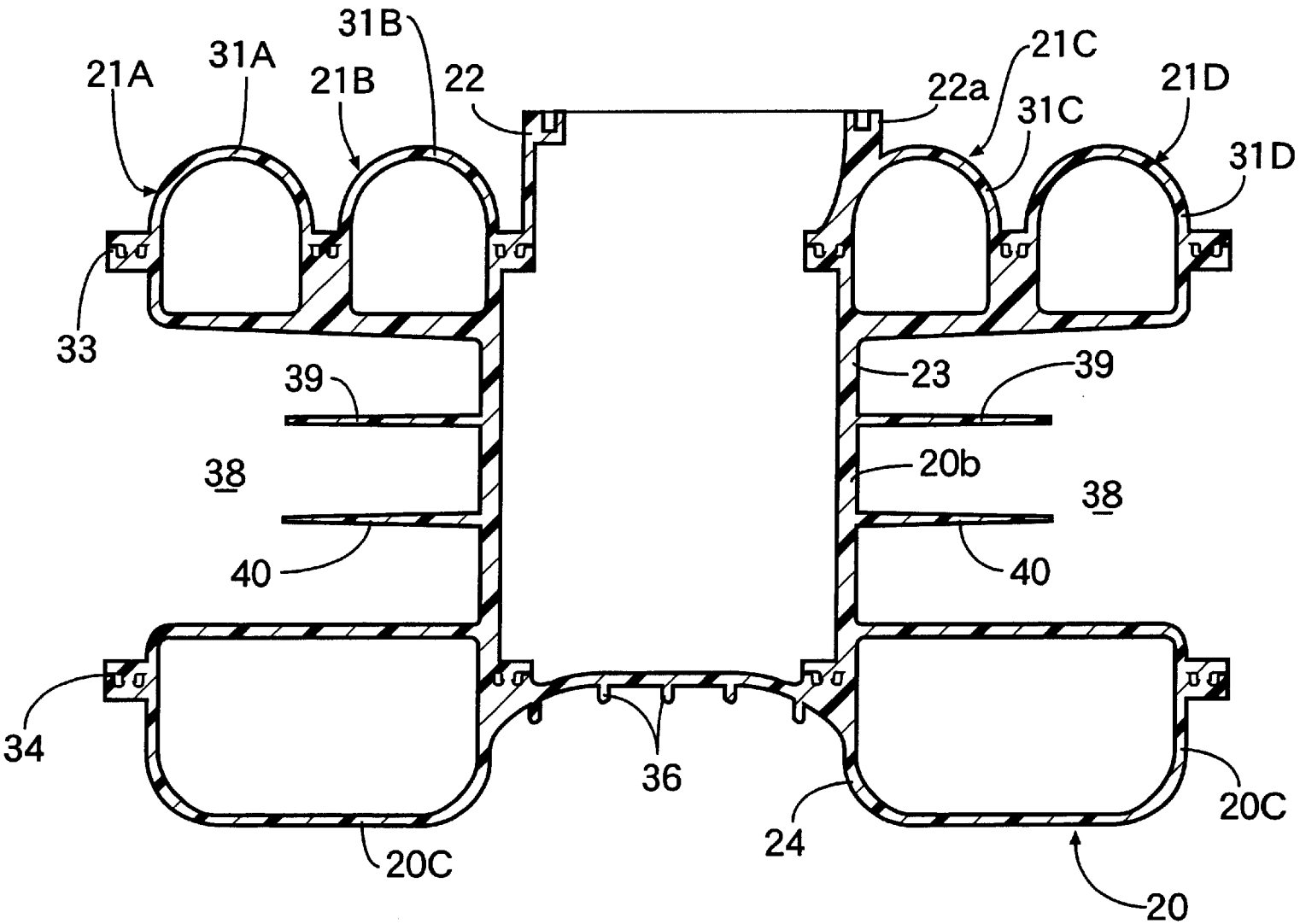

Referring also to FIG. 8, spaces 38, 38 closed at upper and lower ends and opened at an outer end are defined between the main tank portion 20*a* of the surge tank 20 and the rising pipe portions 29A, 29B; 29C, 29D of the intake pipes 21A, 21B; 21C, 21D disposed in pairs on opposite sides of the sideways-bulged portion 20*b* of the surge tank 20, so that they are disposed on the opposite sides of the sideways-bulged portion 20*b* included in the surge tank 20. Inner ends of the spaces 38, 38 are closed by opposite sidewalls of the sideways-bulged portion 20*b*, respectively.

Moreover, pairs of upper and lower connecting walls 39, 40; 39, 40 are disposed within the spaces 38, 38, respectively to interconnect the sidewalls of the sideways-bulged portion 20*b*, the rising pipe portions 29A, 29B; 29C, 29D and the main tank portion 20*a*. Each of the pairs of the connecting walls 39, 40 are disposed at locations such that the volume of a space portion between a ceiling wall of the space 38 and the connecting wall 39, the volume of a space portion between both of the connecting walls 39 and 40 and the volume of a space portion between the connecting wall 40 and a bottom wall of the space 38 are different from one another.

Further, upper one 39 of the pair of upper and lower connecting walls 39 and 40 is disposed on a plane 41 intersecting the junction 33 between the first and second bonded parts 22 and 23, as shown in FIG. 4.

Figure 6:
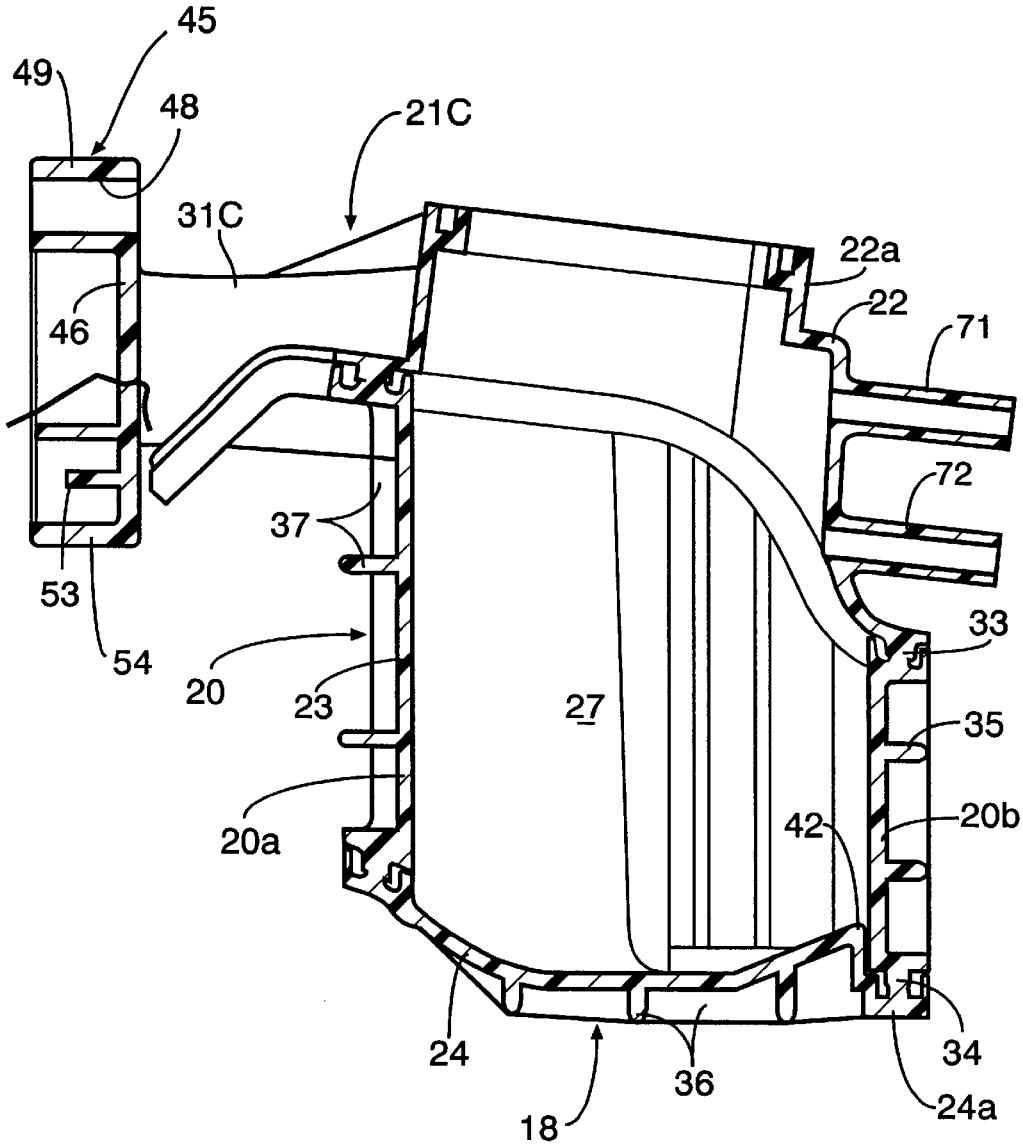
Figure 7:
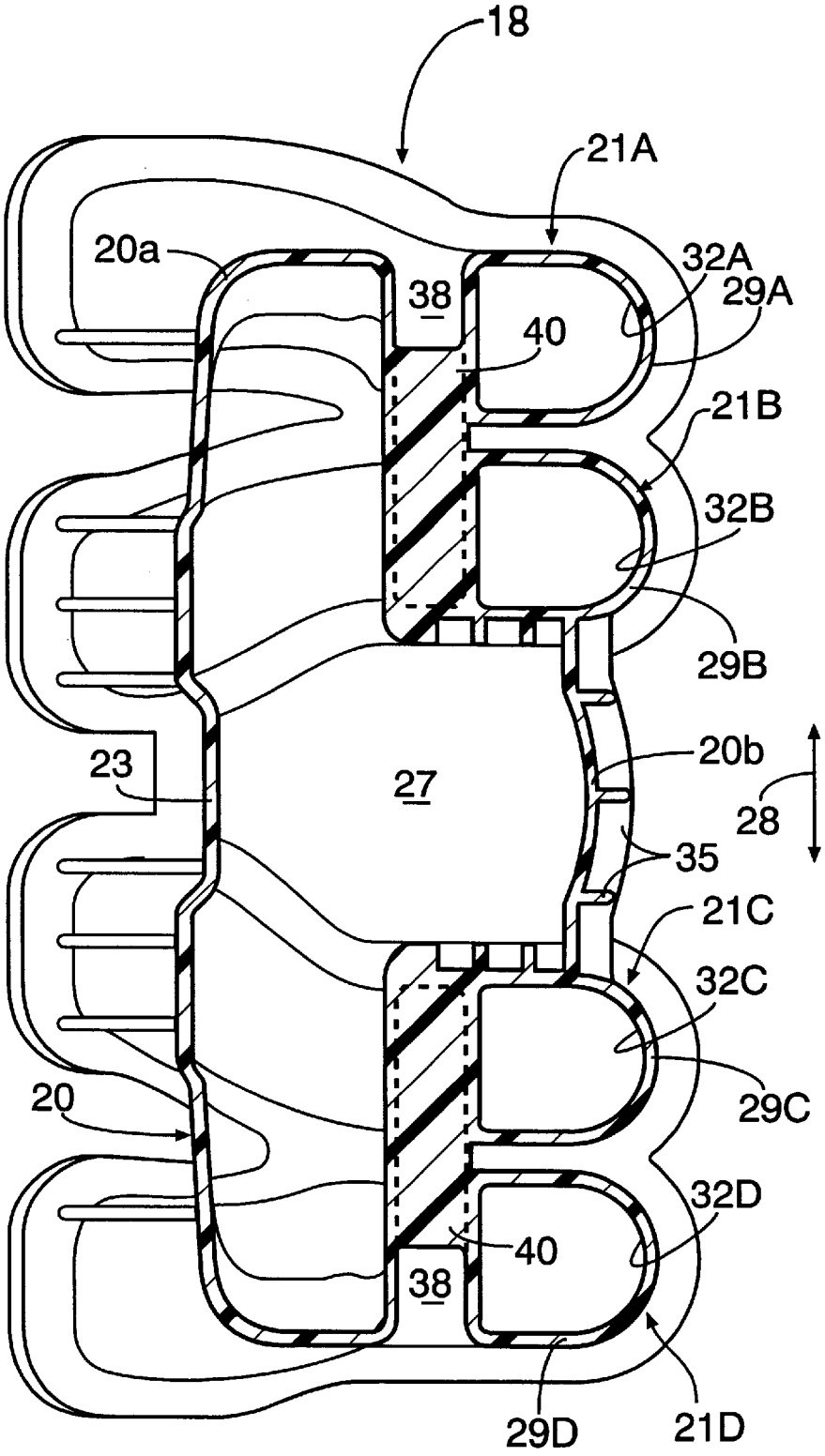

A portion 42 bent toward the inside of the surge tank 20 is formed on third one 24 of the first, second and third bonded parts 22, 23 and 24 forming the intake manifold 18 at a location forming the bottom wall of the sideways-bulged portion 20*b*, as shown in FIG. 6. The rib 36 connected to the junction 34 is provided on an outer surface of the bent portion 42. Moreover, a bonding collar 24*a* is integrally formed on an outer periphery of the third bonded part 24 to protrude from the bent portion 42, so that it is bonded to the second bonded part 23.

A flange 45 is commonly and integrally connected to the straight pipe portions 31A to 31D of the intake pipes 21A to 21D and fastened to the cylinder head 14 of the engine body 11. The flange 45 includes a flat base plate 46, connecting tubular portions 47A, 47B, 47C and 47D individually leading to the straight pipe portions 31A to 31D of the intake pipes 21A to 21D and connected at right angles to the base plate 46, and a plurality of, e.g., eight boss portions 49 which are formed into a tubular shape to have bolt insertion bores 48 for fastening the flange 45 to the cylinder head 14 of the engine body 11, and are connected at right angles to the base plate 46 at upper and lower locations between the connecting tubular portions 47A, 47B, 47C and 47D and locations corresponding to opposite ends of the base plate 46.

Each of the connecting tubular portions 47A, 47B, 47C and 47D is formed, so that it has a laterally long elliptic cross-sectional shape. Provided end faces of the connecting tubular portions 47A, 47B, 47C and 47D on the side of the engine body 11 are endless elliptic seal-mounting grooves 50, and grooves 51 which are connected at their inner ends to the seal-mounting grooves 50 and open at their outer ends into a side of an upper portion of the flange 45. Seal members 52, for example, O-rings integrally provided with protrusions 52*a* to be fitted into the grooves 51 are interposed between the flange 45 and the cylinder head 14 of the engine body 11 and are mounted in the seal-mounting grooves 50, respectively.

A plurality of radiate ribs 53 are provided on the base plate 46 to extend radiately from the boss portions 49, so that they are connected to the connecting tubular portions 47A to 47D adjacent the boss portions 49, and outer peripheral ribs 54 are also provided on the base plate 46 to connect the boss portions 49 and the connecting tubular portions 47A to 47D to each other. The outer peripheral ribs 54 are connected to outer peripheries of the connecting tubular portions 47A to 47D on opposite sides of the grooves 51.

Further, the base plate 46 is provided with the following ribs: ribs 55, 55 which interconnect the connecting tubular portions 47A and 47B and interconnect the connecting tubular portions 47C and 47D; and a cross-shaped rib 56 which interconnects the connecting tubular portions 47B and 47C and interconnects the outer peripheral ribs 54.

The intake manifold 18 is fastened to the cylinder head 14 by the flange 45. Support stays 67 and 68 disposed below the downward-bulged portions 20*c*, 20*c* included in the surge tank 20 in the intake manifold 18 are fastened to the cylinder block 12, and the downward-bulged portions 20*c*, 20*c* are supported by the support stays 67 and 68. Moreover, an occupied space is created below the bottom wall of the central portion of the surge tank 20, since the bottom wall of the central portion of the surge tank 20 protrudes more upwards than the downward-bulged portions 20*c*, 20*c*. In order to effectively utilize the unoccupied space, an auxiliary, e.g., an oil filter 65 is mounted to the cylinder block 12 between the support stays 67 and 68, so that a portion of the oil filter 65 is disposed above the downward-bulged portions 20*c*, 20*c* below the central portion of the surge tank 20.

It should be noted here that the air cleaner 16 is connected to an upper end of the throttle body 17 connected to a substantially central portion of the intake manifold 18 in the direction 28 of arrangement of the intake pipes 21A to 21D, but is disposed in such a manner that it is offset toward the intake pipe 21D in the arrangement direction 28 on the intake manifold 18. However, the stay 58 is fastened onto a pair of support bosses 57, 57 projectingly provided on the curved portion 30D of the intake pipe 21D, and a resilient member 59 provided at a lower portion of the air cleaner 16 at a location corresponding to the intake pipe 21D is placed on the stay 58, whereby the air cleaner 16 is supported with a good balance by the throttle body 17 and the stay 58.

Moreover, the support bosses 57, 57 are provided on the curved pipe portions 30D side by side in a lengthwise direction of the intake pipe 21D, and the stay 58 is fastened to the support bosses 57, 57 with a shape to extend along the lengthwise direction of the intake pipe 21D. Thus, the rigidity of mounting of the stay 58 can be enhanced, while inhibiting the protrusion of the stay 58 from the intake manifold 18.

A pair of clamp members 61, 61 are mounted to the stay 58, and conduits 60, 60 for guiding a fluid such as cooling water are clamped by the clamp members 61, 61.

In this way, the stay 58 supporting a portion of the air cleaner 16 can be used effectively to support the conduits 60, 60, which can contribute to a reduction in number of parts. Moreover, the stay 58 is formed into an L-shape in vertical section along the curved pipe portion 30D of the intake pipe 21D. Such stay 58 enables the stable supporting of the air cleaner 16 and the conduits 60, 60, while an increase in size of stay 58 is inhibited. Further, the conduits 60, 60 are disposed below the air cleaner 16 and hence, the compact attachment of the conduits 60, 60 can be achieved.

A throttle wire 64 wound around the throttle drum 26 of the throttle body 17 is pulled toward the intake pipe 21A in the direction 28 of arrangement of the intake pipes 21A to 21D, but a pair of support bosses 62, 62 are provided on the curved portion 30A of the intake pipe 21A side by side in a direction of pulling of the throttle wire 64, i.e., in the arrangement direction 28, and a wire sheath 64*a* of the throttle wire 64 is retained by a support stay 63 fastened to the support bosses 62, 62. Such a retaining structure for the throttle wire 64 ensures that the rigidity of mounting of the support stay 63 to the intake manifold 18 can be increased.

Further, the connecting tubular portion 22*a* included in the first bonded part 22 is integrally formed with a connecting pipe 71 for connection of a conduit for guiding an evaporated fuel purged from a fuel tank (not shown), and a connecting pipe 72 for connection of a conduit for guiding a negative pressure to a vacuum booster (not shown) for a brake. The connecting pipes 71, 72 are disposed between the curved pipe portions 30B and 30C of the intake pipes 21B and 21C above the sideways-bulged portion 20*b* of the surge tank 20. A space is created between the curved pipe portions 30B and 30C by disposition of the sideways-bulged portion 20*b* between the rising pipe portions 29B and 29C of the intake pipes 21B and 21C. This space can be utilized effectively to dispose the connecting pipe portions 71 and 72, thereby contributing to a reduction in size of the intake manifold 18.

The operation of the first embodiment will be described below. The surge tank 20 including the intake manifold 18 formed by bonding the first, second and third bonded parts 22, 23 and 24 each made of the synthetic resin, together with the plurality of intake pipes 21A to 21D includes the main tank portion 20*a* disposed sideways of the engine body 11, the sideways-bulged portion 20*b* bulged to the side opposite from the engine body 11 from the intermediate portion of the main tank portion 20*a* to form the T-shape together with the main tank portion 20*a*, and the pair of downward-bulged portions 20*c*, 20*c* bulged downwards from the opposite ends of the main tank portions 20*a*. On the other hand, the intake pipes 21A to 21D are connected to the lower portion of the surge tank 20, i.e., to the downward-bulged portions 20*c*, 20*c*, respectively, and are disposed side by side to have the rising pipe portions 29A to 29D extending upwards on the side of the main tank portion 20*a* opposite from the engine body 11, respectively. The sideways-bulged portion 20*b* of the surge tank 20 is disposed, so that it is interposed between the rising pipe portions 29B and 29C included in the pair of intake pipes 21B and 21C disposed at the intermediate locations in the direction 28 of arrangement of the intake pipes 21A to 21D. Thus, it is possible to provide an increase in volume of the surge tank 20.

Moreover, the lattice-shaped rib 35 is projectingly provided on the outer surface of the end wall of the sideways-bulged portion 20*b*. The lattice-shaped rib 35 connects the rising pipe portions 29B and 29C to each other on opposite sides of the sideways-bulged portion 20*b* and is connected to the junctions 33 and 34 between the first, second and third bonded parts 22, 23 and 24 forming at least a portion of the surge tank 20 (the entire surge tank 20 in the present embodiment). Therefore, the connection rigidity of the surge tank 20 and the intake pipes 21B and 21C can be increased remarkably by the lattice-shaped rib 35, thereby increasing the entire rigidity of the intake manifold 13 to reduce the radiated sound. In addition, the rigidity of the junctions 33 and 34 can be further increased by the connection of the vertically opposite ends of the rib 35 to the junctions 33 and 34.

The lattice-shaped rib 36 is projectingly provided on the outer surface of the bottom wall of the central portion of the surge tank 20 sandwiched between the downward-bulged portions 20*c*, 20*c* to connect the downward-bulged portions 20*c*, 20*c* to each other, and is connected to the junction 34 between the second and third bonded parts 23 and 24 forming a portion of the surge tank 20. Therefore, the rigidity of the surge tank 20 can be increased remarkably by the lattice-shaped rib 36 projectingly provided on the outer surface of the bottom wall of the central portion of the surge tank 20 by effectively utilizing the unoccupied space created between the pair of downward-bulged portions 20*c*, 20*c*, while avoiding the increase in size of the intake manifold 18, thereby increasing the entire rigidity of the intake manifold 18 to reduce the radiated sound. In addition, the rigidity of the junction 34 can be further increased by the connection of the opposite ends of the rib 36 to the junction 34.

Further, the lattice-shaped rib 37 is projectingly provided on the entire surface, for example, of the outer surface of the main tank portion 20*a* on the side of the engine body 11 and connected to the junctions 33 and 34 between the first, second and third bonded parts 22, 23 and 24 forming the surge tank 20, and the rigidity of the surge tank 20 can be increased remarkably by the rib 37 disposed by effectively utilizing the space between the surge tank 20 and the engine body 11, while avoiding the increase in size of the intake manifold 18, thereby increasing the entire rigidity of the intake manifold 18 to reduce the radiated sound. In addition, the rigidity of the junctions 33 and 34 can be further increased by the connection of the upper and lower opposite ends of the rib 37 to the junctions 33 and 34.

Moreover, the provision of the lattice-shaped ribs 35, 36 and 37 on the three faces of the surge tank 20 as in the present embodiment makes it possible to further increase the rigidity of the surge tank 20, to reduce the radiated sound further effectively, and to further increase the bond rigidity of the junctions 33 and 34 of the entire surge tank 20.

As viewed sideways in a direction parallel to the direction 28 of arrangement of the intake pipes 21A to 21D, the space 38 defined between the main tank portion 20*a* of the surge tank 20 and the rising pipe portions 29A to 29D of the intake pipes 21A to 21D is bisected by the sideways-bulged portion 20*b* of the surge tank 20, and the inner ends of the pair of spaces 38, 38 defined between the rising pipe portions 29A to 29D and main tank portion 20*a* on the opposite sides of the sideways-bulged portion 20*b* are closed by the opposite sidewalls of the sideways-bulged portion 20*b*, respectively.

Therefore, as viewed sideways in the direction parallel to the direction 28 of arrangement of the intake pipes 21A to 21D, the spaces 38, 38 exist between the surge tank 20 and the rising pipe portions 29A to 29D, as in the prior art, and nevertheless, a portion sandwiched between the spaces 38, 38 can be utilized effectively as a portion of the surge tank 20 and hence, the volume of the surge tank 20 can be increased, while avoiding the increase in size of the entire intake manifold 18.

In addition, the opposite sidewalls of the sideways-bulged portion 20*b* forming a portion of the surge tank 20 is disposed at a location displaced inwards from the opposite ends of the intake manifold 18 in the direction 28 of arrangement of the intake pipes 21A to 21D and hence, the leakage of the radiated sound of the opposite sidewalls of the sideways-bulged portion 20*b* to the outside can be inhibited as much as possible, and it is easy to form the surge tank 20. Namely, to increase the volume of the surge tank 20, it is convenient that the inner end of the space 38 is closed at a location closer to the opposite ends of the intake manifold 18 in the arrangement direction 28. However, if the inner end of the space 38 is closed at such location, the amount of radiated sound leaked from the surge tank 20 is increased.

The sideways-bulged portion 20*b*, the rising pipe portions 29A to 29D of the intake pipes 21A to 21D and the main tank portion 20*a* are connected together by the connecting walls 39, 40; 39, 40 respectively disposed within the spaces 38, 38 and hence, the connection rigidity of the surge tank 20 and the intake pipes 21A to 21D can be increased to reduce the radiated sound from the intake manifold 18. Moreover, since the connecting walls 39 and 40 are disposed within the space 38, the size of the intake manifold 18 cannot be increased due to the provision of the connecting walls 39 and 40.

The plurality of, e.g., the pairs of intake pipes 21A, 21B; 21C, 21D are disposed on the opposite sides of the sideways-bulged portion 20*b*, and the rising pipe portions 29A, 29B; 29C, 29D of the pair of intake pipes 21A, 21B; 21C, 21D are connected to each other by the connecting walls 39 and 40. Therefore, the rigidity of the intake pipes 21A, 21B, 21C and 21D is further increased and hence, the radiated sound from each of the intake pipes 21A, 21B, 21C and 21D can be further reduced.

Upper one 39 of the connecting walls 39 and 40 is disposed on the plane 41 intersecting the junction 33 between the first and second bonded parts 22 and 23. Therefore, the connecting wall 39 enables the bond rigidity of the junction 33 to be increased in such a manner that the second bonded part 23 is prevented from being flexed in a direction to release the bonding of the junction 33.

Moreover, the connecting walls 39 and 40 are disposed at the locations such that the volume of the space portion of the space 38 between the ceiling wall of the space 38 and the connecting wall 39, the volume of the space portion between the connecting walls 39 and 40 and the volume of the space portion between the connecting wall 40 and the bottom wall of the space 38 are different from one another. This ensures an excellent effect of attenuating the radiated sound.

The bent portion 42 bent toward the inside of the surge tank 20 is formed on third one 24 of the first, second and third bonded parts 22, 23 and 24 forming the intake manifold 18, and the rib 36 is provided on the outer surface of the bent portion 42 and connected to the junction 34 between the second and third bonded parts 23 and 24.

The rigidity of a portion of the third bonded part 24 at a location facing the surge tank 20 can be increased by the bent portion 42 and the rib 36. In addition, since the rib 36 is connected to the junction 34, the pressure-resistant strength of the junction 34 to a variation in pressure can be increased with a simple structure and thus, the durability of the junction 34 can be enhanced.

Additionally, the bonding collar 24*a* is formed on the outer periphery of the third bonded part 24 to protrude the bent portion 42, so that it is bonded to the second bonded part 23, and the bent portion 42 is formed on the third bonded part 24 in the proximity to the junction 34 between the pair of bonded parts 23 and 24. Thus, it is possible to further enhance the durability of the junction 34 bonding the bonded parts 23 and 24 to each other.

Moreover, the bent portion 42 is disposed to face the inside of the surge tank 20 and hence, an influence exerted on a flow of intake air flowing in the intake manifold 18 by the bent portion 42 is small. Particularly, in the present embodiment, the bent portion 42 is formed on the third bonded part 24 at the location corresponding to the bottom wall of the sideways-bulged portion 20*b* of the surge tank 20, and a main flow of the intake air in the surge tank 20 is directed from the main tank portion 20*a* toward both the downward-bulged portions 20*c*, 20*c* and hence, the influence exerted on the flow of the intake air by the bent portion 42 can be further reduced.

The flange 45 connected commonly to the intake pipes 21A, 21B, 21C and 21D includes the base plate 46 formed into a flat plate and connected commonly to the intake pipes 21A, 21B, 21C and 21D, the plurality of connecting tubular portions 47A, 47B, 47C and 47D which have the endless seal-mounting grooves 50 on their end faces on the side of the engine body 11 and individually lead to the intake pipes 21A, 21B, 21C and 21D to be connected to the base plate 46, the plurality of boss portions 49 which are each formed into the tubular shape with the bolt-insertion bores 48 defined therein and are connected to the base plate 46 so as to be respectively disposed at least at the upper and lower locations between the connecting tubular portions 47A, 47B, 47C and 47D, and the plurality of radiate ribs 53 extending radiately from the boss portions 49 and connected to the base plate 46 so as to be connected to the connecting tubular portions 47A, 47B, 47C and 47D adjacent the boss portions 49.

With the flange 45 having such arrangement, the rigidity of fastening of the flange 45 to the engine body 11 can be increased by the radiate ribs 53, while avoiding an increase in thickness of the entire flange 45 to prevent an increase in weight of the flange 45. Moreover, a fastening force is applied to a plurality of circumferential points of each of the connecting tubular portions 47A to 47D from the boss portions 49 through the radiate ribs 53. This enhances the sealing performance provided by the seal members 52 mounted in the seal-mounting grooves 50 provided in the end faces of the connecting tubular portions 47A to 47D on the side of the engine body 11.

Further, the boss portions 49 are disposed around the outer periphery of the base plate 46, and the outer peripheral ribs 54 connecting the boss portions 49 and the connecting tubular portions 47A to 47D to each other are connected to the outer periphery of the base plate 46. This also makes it possible to increase the rigidity of fastening of the flange 45 to the engine body 11, while avoiding the increase in thickness of the entire flange 45 to prevent the increase in weight of the flange 45.

In addition to the radiate ribs 53 and the outer peripheral ribs 54, the base plate 46 is provided with the ribs 55, 55 interconnecting the connecting tubular portions 47A and 47B and interconnecting the connecting tubular portions 47C and 47D, and with the cross-shaped rib 56 interconnecting the connecting tubular portions 47B and 47C and interconnecting the outer peripheral ribs 54. Thus, the rigidity of the flange 45 can be further increased by these ribs 55, 55 and 56.

Moreover, in addition to the endless seal-mounting grooves 50, the end faces of the connecting tubular portions 47A to 47D on the side of the engine body 11 are provided respectively with the grooves 51 which are connected at their inner ends to the seal-mounting grooves 50, and open at their outer end into the side face of the upper portion of the flange 45, and the seal member 52 mounted in each of the seal-mounting grooves 50 is integrally provided with the protrusion 52*a* fitted in the corresponding groove 51. Therefore, in a state in which the flange 45 has been fastened to the engine body 11, the presence or absence of the protrusion 52*a*, i.e., the presence or absence of the seal member 52 can be visually checked from outside the flange 45.

In addition, since the grooves 51 open into the side face of the upper portion of the flange 45, the protrusion 52*a* of the seal member 52 can be checked easily, visually from above the flange 45 and hence, the presence or absence of the seal member 52 can be checked further easily.

Further, since the outer peripheral ribs 54 are connected to the connecting tubular portions 47A to 47D on the opposite sides of the grooves 51, it is possible to prevent the reduction in rigidity of the connecting tubular portions 47A to 47D due to the provision of the grooves 51, to inhibit the reduction in sealing performance provided the seal member 52, to inhibit the increase in size of the flange 45 and moreover to reduce the length of each of the grooves 51 to form the protrusion 52*a* at a small size.

Figure 9:
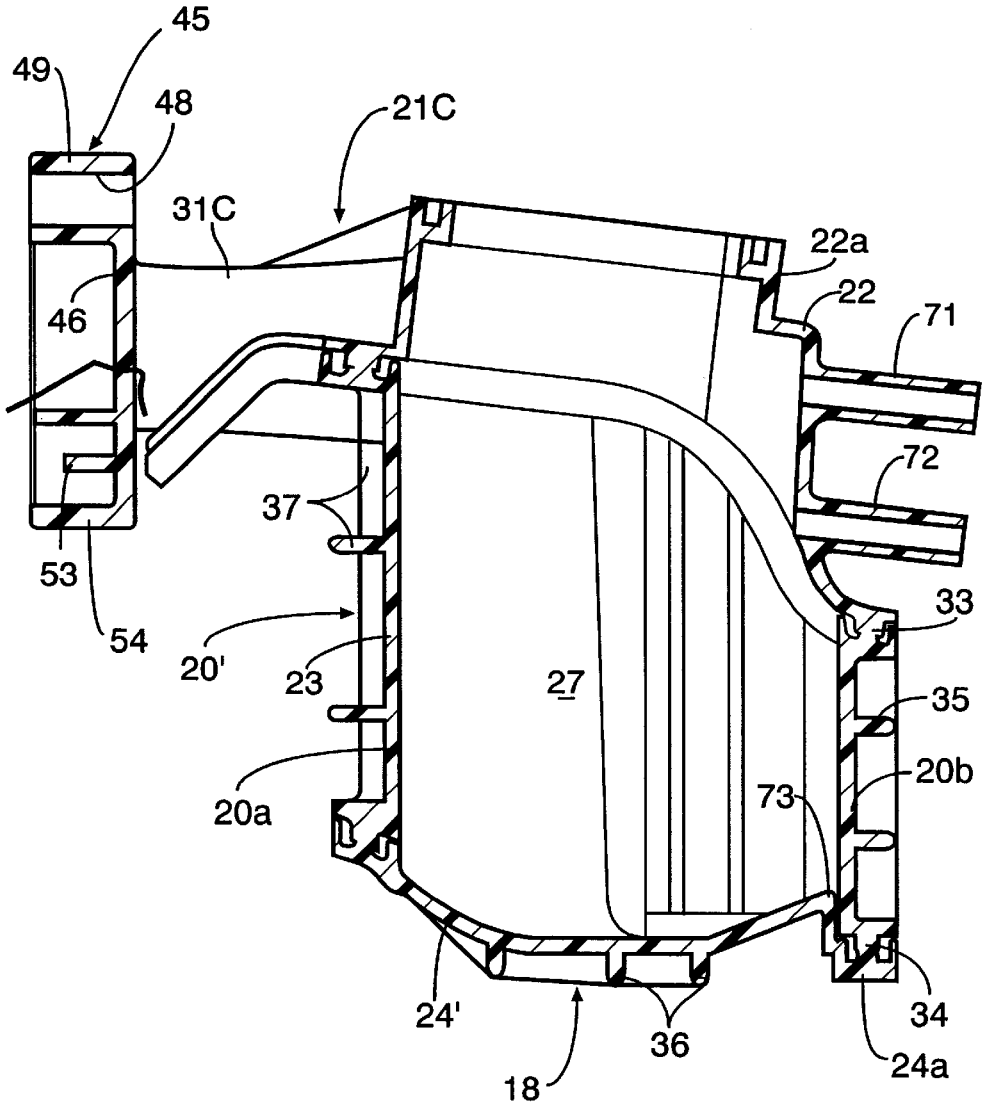
FIG. 9 is a sectional view similar to FIG. 6, but according to a second embodiment of the present invention.

FIG. 9 shows a second embodiment of the present invention, wherein portions or components corresponding to those in the first embodiment are designated by like reference characters.

A pressure-variation absorbing portion 73 for absorbing a variation in pressure in a surge tank 20' and in each of intake pipes 21A to 21D by flexing thereof is formed on third one 24' of first, second and third bonded parts 22, 23 and 24' forming an intake manifold 18' at a portion defining a bottom wall of a sideways-bulged portion 20*b* of the surge tank 20'. The pressure-variation absorbing portion 73 is formed on the third bonded-part 24' with such a shape that it is bent toward the inside of the surge tank 20', and a bonding collar 24*a* for bonding to the second bonded part 22 is formed on an outer periphery of the third bonded part 24' to protrude from the pressure-variation absorbing portion 73. Moreover, a lattice-shaped rib 36 is projectingly provided on an outer surface of a bottom wall of a central portion of the surge tank 20' and disposed clear of the pressure-variation absorbing portion 73 in order to facilitate the flexing of the pressure-variation absorbing portion 73.

According to the second embodiment, the pressure-variation absorbing portion 73 for absorbing a variation in pressure in the surge tank 20' and in each of the intake pipes 21A to 21D by flexing thereof is formed on the third bonded part 24' and hence, even if a variation in pressure due to a back-fire of an engine or the like is produced within the intake manifold 18, such variation in pressure can be absorbed by the flexing of the pressure-variation absorbing portion 73. Therefore, it is possible to reduce a load applied to each of junctions 33 and 34 between the bonded parts 22, 23 and 24' to increase the pressure-resistant strength of the junctions 33 and 34 to contribute to an enhancement in durability of the junctions 33 and 34.

Moreover, the bonding collar 24*a* is formed on the outer periphery of the third bonded part 24' to protrude from the pressure-variation absorbing portion 73, and the pressure-variation absorbing portion 73 is formed on the third bonded part 24' in the proximity to the junction 34 between the second and third bonded parts 23 and 24'. Therefore, it is possible to further enhance the durability of the bonded part 34.

Further, since the pressure-variation absorbing portion 73 is disposed to face the inside of the surge tank 20, an influence exerted on the flow of intake air flowing within the intake manifold 18 by the pressure-variation absorbing portion 73 is small.

Alternatively, the pressure-variation absorbing portion 73 may be formed by a plurality of bent portions, or the thickness of the pressure-variation absorbing portion 73 may be smaller than those of other portions. If so, it is convenient for absorbing a variation in pressure.

Although the embodiments of the present invention have been described in detail, it will be understood that the present invention is not limited to the above-described embodiments, and various modifications in design may be made without departing from the spirit and scope of the invention defined in claims.

What is claimed is:

1. An intake manifold formed by bonding a plurality of bonded parts (22, 23, 24, 24') made of synthetic resin to one another, and including a surge tank (20, 20') disposed sideways of an engine body (11), and a plurality of intake pipes (21A, 21B, 21C, 21D) disposed in parallel to one another and each having a rising pipe portion (29A, 29B, 29C, 29D) which is connected to a lower portion of said surge tank (20, 20') on a side opposite from said engine body (11) and extends upwards, a space (38) being defined between said surge tank (20) and each of said rising pipe portions (29A to 29D), as viewed sideways in a direction parallel to a direction (28) of arrangement of said intake pipes (21A to 21D), characterized in that said surge tank (20, 20') includes a main tank portion (20*a*) extending in the direction (28) of arrangement of said intake pipes (21A to 21D) and opposed to the rising pipe portions (29A to 29D) of said intake pipes (21A to 21D), and a sideways-bulged portion (20*b*) which is bulged to a side opposite from said engine body (11) from an intermediate portion of said main tank portion (20*a*) as viewed in said arrangement direction (28) to form a cross-sectional T-shape by cooperation with said main tank portion (20*a*), said sideways bulged portion being interposed between the rising pipe portions (29B, 29C) of a pair of the intake pipes (21B, 21C) disposed at the intermediate portion as viewed in said arrangement direction (28), and inner ends of a pair of spaces (38) defined respectively between the rising pipe portions (29A to 29D) of said intake pipes (21A to 21D) and said main tank portion (20*a*) on opposite sides of said sideways-bulged portion (20*b*) are closed by opposite sidewalls of said sideways-bulged portion (20*b*).

2. An intake manifold according to claim 1, wherein said sideways-bulged portion (20*b*), the rising pipe portions (29A to 29D) of said intake pipes (21A to 21D) and said main tank portion (20*a*) are connected together by connecting walls (39 and 40) disposed in said spaces (38), respectively.

3. An intake manifold according to claim 2, wherein a plurality of the intake pipes (21A, 21B; 21C, 21D) are disposed on each of the opposite sides of said sideways-bulged portion (20*b*), the rising pipe portions (29A, 29B; 29C, 29D) of said plurality of intake pipes (21A, 21B; 21C, 21D) being connected to each other by said connecting walls (39, 40).

4. An intake manifold according to claim 2 or 3, wherein said connecting walls (39) are disposed on a plane (41) intersecting a junction (33) between the parts (22 and 23) bonded to each other.

5. An intake manifold according to claim 2 or 3, wherein a pair of connecting walls (39,40) are disposed in said space (38) at locations such that the volume of a space portion between a ceiling wall of said space (38) and one of said connecting walls (39), the volume of a space portion between both of said connecting walls (39, 40) and the volume of a space portion between a bottom wall of said space (38) and the other connecting wall (40) are different from one another.

6. An intake manifold according to claim 1, further including a lattice-shaped rib (35) which is projectingly provided on an outer surface of an end wall of said sideways-bulged portion (20*b*) to connect said rising pipe portions (29B, 29C) on opposite sides of said sideways-bulged portion (20*b*) to each other, said rib (35) being connected to junctions (33 and 34) between the plurality of bonded parts (22, 23, 24) forming at least a portion of said surge tank (20).

7. An intake manifold according to claim 1, wherein said surge tank (20) further includes a pair of downward-bulged portions (20*c*) bulged downwards from opposite ends of said main tank portion (20*a*) and connected to lower ends of said rising pipe portions (29A to 29D), and a lattice-shaped rib (36) is projectingly provided on an outer surface of a bottom wall of the central portion of said surge tank (20) sandwiched between said downward-bulged portions (20*c*) to connect said downward-bulged portions (20*c*) to each other, said lattice-shaped rib (36) being connected to a junction (34) between the plurality of bonded parts (23, 24) forming at least a portion of said surge tank (20).

8. An intake manifold according to claim 1, further including a lattice-shaped rib (37) which is projectingly provided on an outer surface of said main tank portion (20*a*) on the side of said engine body (11) and connected to junctions (33, 34) between the plurality of bonded parts (22, 23, 24) forming at least a portion of said surge tank (20).

9. An intake manifold according to claim 1, further including a flange (45) commonly connected to the plurality of intake pipes (21A, 21B, 21C, 21D) and fastened to said engine body (11), said flange (45) including a base plate (46) formed into a flat shape and connected commonly to said intake pipes (21A to 21D), a plurality of connecting tubular portions (47A, 47B, 47C and 47D) which have endless seal-mounting grooves (50) in end faces thereof on the side of said engine body (11), and individually lead to said intake pipes (21A to 21D) to be connected to said base plate (46), a plurality of boss portions (49) which are formed into a tubular shape with bolt-insertion bores (48) provided therein for fastening said flange (45) to said engine body (11), and are connected to said base plate (46) so as to be respectively disposed at least at upper and lower locations between said connecting tubular portions (47A to 47D), and a plurality of radiate ribs (53) which extend radiately from said boss portions (49) and are connected to said base plate (46) so as to be connected to said connecting tubular portions (47A to 47D) adjacent said boss portions (49), wherein a plurality of seal members (52) are mounted in said seal-mounting grooves (50), respectively, and interposed between said flange (45) and said engine body (11).

10. An intake manifold according to claim 1, further including a flange (45) commonly connected to the plurality of intake pipes (21A, 21B, 21C, 21D) and fastened to said engine body (11), said flange (45) including a base plate (46) formed into a flat shape and connected commonly to said intake pipes (21A to 21D), a plurality of connecting tubular portions (47A, 47B, 47C, 47D) which have endless seal-mounting grooves (50) and grooves (51) in end faces thereof on the side of the engine body, said grooves (51) being connected at inner ends thereof to said seal-mounted grooves (50) and opening at outer ends thereof into a side of said flange (45), said connecting tubular portions (47A, 47B, 47C, 47D) individually leading to the intake pipes and being connected to said base plate (46), a plurality of boss portions (49) which are formed into a tubular shape with bolt-insertion bores (48) provided therein for fastening said flange (45) to said engine body (11), and are connected to an outer periphery of said base plate (46) so as to be disposed at least at upper and lower locations between said connecting tubular portions (47A to 47D), and an outer peripheral rib (54) which connects said connecting tubular portions (47A to 47D) and said boss portions (49) to each other, and are connected to opposite sides of said grooves (51) in said connecting tubular portions (47A to 47D) and to the outer periphery of said base plate (46), wherein a plurality of seal members (52) integrally provided with protrusion (52*a*) to be fitted into said grooves (51) are mounted in said seal-mounting grooves (50), respectively, and interposed between said flange (45) and said engine body (11).

11. An intake manifold according to claim 1, wherein said bonded part (24) forming a portion of said surge tank (20) is formed with a bent portion (42) bent toward the inside of said surge tank (20), said bent portion (42) being provided at an outer surface thereof with a rib (36) connected to a junction (34) between said bonded part (24) having said bent portion (42) and the other bonded part (23).

12. An intake manifold according to claim 11, wherein said bonded part (24) having said bent portion (42) is formed with a bonding collar (24*a*) protruding from said bent portion (42) to become bonded to the other bonded part (23).

13. An intake manifold according to claim 1, wherein at least one (24') of said bonded parts (22 to 24') is formed with a pressure-variation absorbing portion (73) for absorbing a variation in pressure within each of said surge tank (20') and said intake pipes (21A to 21D) by the flexing thereof.

14. An intake manifold according to claim 13, wherein said pressure-variation absorbing portion (73) of a shape bent toward the inside of the surge tank (20) is formed on said bonded part (24') forming a portion of said surge tank (20').

* * * * *